US006763210B2

(12) United States Patent
Sato et al.

(10) Patent No.: US 6,763,210 B2
(45) Date of Patent: Jul. 13, 2004

(54) METHOD OF REFILLING USED DEVELOPING CARTRIDGE

(75) Inventors: Fumikazu Sato, Inuyama (JP); Masatoshi Sakaguchi, Gifu (JP); Soichiro Nishimura, Handa (JP); Mitsuru Horinoe, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/383,562

(22) Filed: Mar. 10, 2003

(65) Prior Publication Data

US 2003/0170046 A1 Sep. 11, 2003

(30) Foreign Application Priority Data

Mar. 11, 2002 (JP) ..... 2002-064854
Mar. 13, 2002 (JP) ..... 2002-068829
Mar. 13, 2002 (JP) ..... 2002-068830

(51) Int. Cl.[7] ..... G03G 15/00

(52) U.S. Cl. ..... 399/109; 399/107; 399/111; 399/119

(58) Field of Search ..... 399/107, 109, 399/111, 222, 224, 252, 255, 258, 119

(56) References Cited

U.S. PATENT DOCUMENTS 6,473,577 B1 * 10/2002 Higeta et al. ..... 399/109
6,621,996 B1 * 9/2003 Meyer et al. ..... 399/109

* cited by examiner

*Primary Examiner*—Hoang Ngo
(74) *Attorney, Agent, or Firm*—Oliff & Berridge PLC

(57) ABSTRACT

A developing device includes a holding chamber for holding developing agent, a port for accessing the holding chamber from outside the developing device, and a developing agent bearing member that bears developing agent from the holding chamber. After the developing device has been used until the holding chamber has run out of developing agent, the used developing device is refilled with developing agent. In the following manner. The port is opened to access the holding chamber. The type of previously-used developing agent that remains in the holding chamber from the preceding developing operation usage is determined. The previously-used developing agent is removed to an amount of 1.2 g or less per centimeter of the axial length of the developing agent bearing member. Then, a type of developing agent that has a lower fluidity characteristic, a lower melting characteristic, or both, than the previously-used developing agent is determined. Then, the holding chamber is refilled with the designated type of developing agent. Afterward, the port is closed.

47 Claims, 3 Drawing Sheets

24

59
27
61
59c
59a
59b
59d
59e
56(56a)

59
61
56
(56a)
24a
24
27
56
(56b)

27
56
(56b)
60

METHOD OF REFILLING USED DEVELOPING CARTRIDGE

BACKGROUND OF THE INVENTION

1. Field of the Invention

The present invention relates to a method of recycling a developing cartridge used in an image forming device, such as a laser printer.

2. Description of the Related Art

Electrophotographic image forming devices, such as laser printers, are normally provided with a detachable developing cartridge. The developing cartridge is filled with toner, and replaced once the toner runs out.

Explained in more detail, the developing cartridge is partitioned into a toner chamber and a developing chamber. The toner chamber is filled with toner and includes an agitator. A supply roller and a developing roller are disposed in contact with each other in the developing chamber. A layer thickness regulating blade is disposed in the developing chamber in pressing contact with the surface of the developing roller.

When mounted into the laser printer, the developing cartridge is brought into connection with gears of the laser printer for providing drive force to rotate the various components of the developing cartridge. When the agitator rotates, it conveys toner from the toner chamber into the developing chamber. When the supply roller rotates, it supplies the toner in the developing chamber to the developing roller. As the toner passes from the supply roller to the developing roller, the toner is triboelectrically charged between the supply roller and the developing roller. Further, as the developing roller rotates, the toner that was supplied onto its surface passes between the developing roller and the layer thickness regulating blade. This regulates the toner layer to a fixed thickness on the surface of the developing roller.

The laser printer in which the development cartridge is used includes a photosensitive drum, components for forming electrostatic latent images on the surface of the photosensitive drum, a transfer roller that is disposed in confrontation with the photosensitive drum, and a sheet transport unit for transporting sheets in between the photosensitive drum and the transfer roller.

The developing cartridge is mounted in the laser printer so that the developing roller confronts the photosensitive drum. Rotation of the developing roller brings the toner on its surface into confrontation with the photosensitive drum. At this time, the toner moves onto an electrostatic latent image formed on the surface of the photosensitive drum, thereby developing the electrostatic latent image into a visible toner image. Rotation of the photosensitive drum moves the visible toner image into confrontation with the transfer roller. At this time, the sheet transport unit transports a sheet between the photosensitive drum and the transfer roller. Electric potential difference developed between the photosensitive drum and the transfer roller draws the visible toner image from the photosensitive drum onto the sheet. In this way, a desired toner image can be formed on the sheet.

When the developing cartridge runs out of toner, then the laser printer will indicate that toner has run out, to urge the user to replace the developing cartridge. The user removes the used developing cartridge and mounts a new developing cartridge in its place.

Up until recently, used developing cartridges were merely discarded. However, it is becoming more common to recycle empty developing cartridges by refilling them up with toner and using them again in a laser printer.

Emulsion polymerization toner, suspension polymerization toner, and other types of polymerization toner are being used more frequently in laser printers. The toner particles of polymerization toner are nearly spherical. This contrasts to the jagged shape of pulverized toner. The spherical-shaped particles of polymerization toner furnish polymerization toner with extremely high fluidity, so that images with extremely high quality can be produced.

A drawback of polymerization toner is that it can easily leak out from the developing cartridge because of its high fluidity. To prevent toner leaks from leaking out from between the developing roller and the casing of the developing cartridge, developing cartridges are provided with seal members at both axial ends of the developing roller, in sliding contact with the surface of the developing roller. However, the seals are abraded down during use of the developing cartridge. This reduces their ability to seal the polymerization toner within the developing cartridge. When the developing cartridge is recycled, the newly added polymerization toner can easily leak through gaps between the seal member and the developing roller to outside the developing cartridge. Therefore, the seal members must be exchanged when the development cartridge is refilled.

Further, the toner that enters in between the seal members and the developing roller can melt by frictional heat generated as the developing roller rotates. The melted toner cools and solidifies once the developing roller stops rotating. When the developing roller is next driven to rotate, the solidified toner can cut into the developing roller and the seal members, thereby quickly degrading the sealing ability of the seal members even further.

Also, the toner itself degrades during use of the developing cartridge. Such degraded toner can result in image fogging. When a used developing cartridge is refilled with toner while a great deal of toner still remains from the previous use, then image fogging can occur when the developing cartridge is reused to form images. In order to prevent this problem, the developing cartridge can be taken apart and cleaned to completely remove previously-used toner before refilling with fresh toner. However, this is extremely troublesome and can increase costs.

SUMMARY OF THE INVENTION

It is an objective of the present invention to provide a method of reusing a used developing device that enables easy refill with developing agent and achieving good image formation during reuse of the developing device.

Methods according to one aspect of the present invention are for refilling a used developing device with developing agent for developing electrostatic latent images. The developing device includes a holding chamber for holding developing agent, a port for accessing the holding chamber from outside the used developing device, and a developing agent bearing member that bears developing agent from the holding chamber.

To achieve the above-described objectives, according to one aspect of the present invention the port is opened to access the holding chamber. A type of previously-used developing agent that remains in the holding chamber from a preceding developing operation usage is determined. A type of developing agent that has a lower fluidity characteristic than the previously-used developing agent is determined. The fluidity characteristic represents fluidity of the developing agent. The holding chamber is refilled with the type of developing agent that has the lower fluidity characteristic. Then, the port is closed.

According to another aspect of the present invention, the port is opened to access the holding chamber. A type of previously-used developing agent that remains in the holding chamber from a preceding developing operation usage is determined. A type of developing agent that has a lower melting characteristic than the previously-used developing agent is designated. The melting characteristic represents ease at which the developing agent melts. The holding chamber is refilled with the type of developing agent that has the lower melting characteristic. Then the port is closed.

According to still another aspect of the present invention, the port is opened to access the holding chamber. Residual developing agent is removed from a preceding developing operation usage of the used developing device to an amount of 1.2 g or less per centimeter of the axial length of the developing agent bearing member. The holding chamber is refilled with developing agent. The port is closed.

BRIEF DESCRIPTION OF THE DRAWINGS

The above and other objects, features and advantages of the invention will become more apparent from reading the following description of the embodiments taken in connection with the accompanying drawings in which:

FIG. 4(*b*) is a right side view showing the developing cartridge of FIG. 2; and FIG. 4(*c*) is a left side view showing the developing cartridge of FIG. 2.

DETAILED DESCRIPTION OF THE EMBODIMENT

Figure 1:
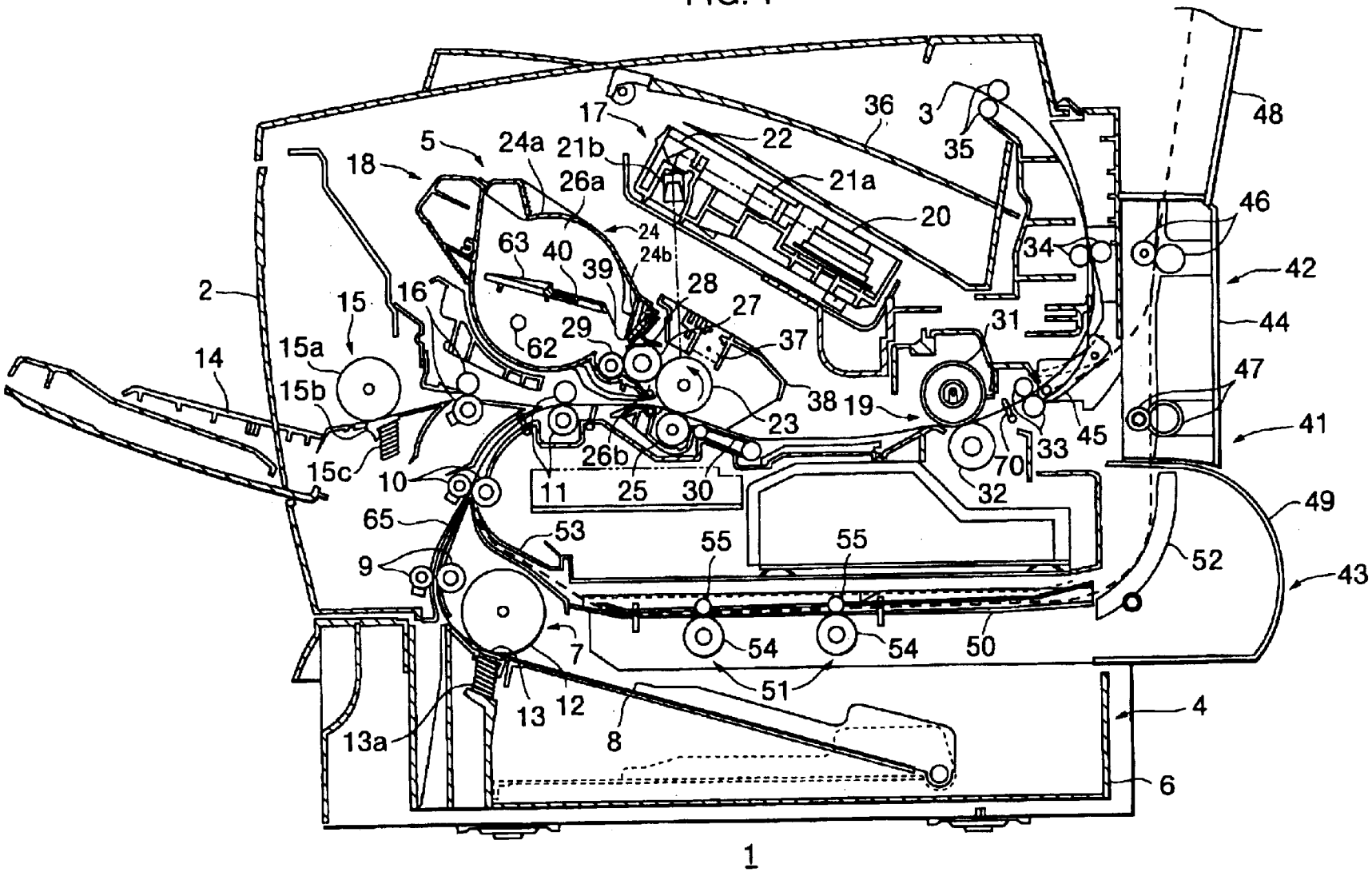
FIG. 1 is a cross-sectional side view showing essential elements of a laser printer including a development cartridge that can be refilled with toner using the method of the present invention.

Next, a laser printer 1 mounted with a development cartridge 24 according to a first embodiment of the present invention will be described while referring to FIG. 1. The laser printer 1 forms images using electrophotographic image forming techniques and includes a casing 2, a feeder section 4, an image forming section 5, and a retransport unit 41. The feeder section 4, the image forming section 5, and retransport unit 41 are provided within the casing 2. The feeder section 4 supplies sheets to the image forming section 5, which forms desired images on the supplied sheets 3. The retransport unit 41 enables images to be formed on both sides of sheets 3.

The feeder section 4 is located within the lower section of the casing 2 and is for supplying sheets 3 to the image forming section 5 via a sheet transport pathway 65. The feeder section 4 includes a sheet supply tray 6, a sheet feed mechanism 7, a sheet pressing plate 8, first transport rollers 9, second transport rollers 10, and registration rollers 11. The sheet supply tray 6 is detachably mounted with respect to the casing 2. The sheet pressing plate 8 is provided in the sheet supply tray 6. The sheet feed mechanism 7 is provided at a downstream end of the sheet supply tray 6 with respect to the direction in which the feeder section 4 transports sheets. Hereinafter, the direction in which sheets are transported with be referred to as the sheet transport direction. Also, in the description below, when one component is referred to as being "upstream" or "downstream" with respect to another component, this refers to the relative positions with respect to the direction in which sheets are transported between the two components. The first transport rollers 9 and the second transport rollers 10 are provided along the sheet transport pathway 65 at a position downstream from the sheet feed mechanism 7. The registration rollers 11 are provided downstream from the first transport rollers 9 and the second transport rollers 10 in the sheet transport direction. The registration rollers 11 are for performing a registration operation on the sheets 3.

The sheet supply tray 6 has a box-like shape with the upper side open. A stack of sheets can be loaded into the sheet supply tray 6 through the open upper side. The sheet supply tray 6 can be detached from and attached to the lower section of the casing 2 by being slid horizontally.

The sheet feed mechanism 7 includes a sheet supply roller 12 and a separation pad 13 disposed in confrontation with each other. A spring 13*a* is disposed to the rear side of the separation pad 13 and urges the pad 13 to press against the supply roller 12.

The sheet pressing plate 8 is for supporting the stack of sheets 3 loaded in the sheet supply tray 6. The end of the sheet pressing plate 8 that is farthest from the supply roller 12 is pivotably supported so that the end that is nearest the supply roller 12 can freely move vertically. Although not shown in the drawings, a spring that urges the sheet pressing plate 8 upward is provided to the rear surface of the sheet pressing plate 8. The sheet pressing plate 8 pivots downward against the urging force of this spring by a distance that corresponds to the number of sheets 3 stacked on the sheet pressing plate 8.

With this configuration, the uppermost sheet 3 in the stack on the sheet pressing plate 8 is pressed against the supply roller 12 by the spring (not shown) under the sheet pressing plate 8. Rotation of the supply roller 12 then draws the uppermost sheet 3 in between the supply roller 12 and the separation pad 13. As the supply roller 12 rotates further, cooperative operation of the supply roller 12 and the separation pad 13 separates the uppermost sheet 3 from the stack and supplies the sheet 3 downstream to the transport rollers 9, 10. In this way, one sheet 3 at a time can be transported downstream from the sheet supply tray 6. The transport rollers 9, 10 send the supplied sheets 3 to the registration rollers 11. The registration rollers 11 perform a registration operation on the sheets 3 before sending them to an image forming position. It should be noted that the image forming position is the transfer position where toner images are transferred from a photosensitive drum 23 (to be described later) onto a sheet 3, that is, is the contact position where the photosensitive drum 23 and a transfer roller 25 (to be described later) contact each other.

The feeder section 4 of the laser printer 1 further includes a multipurpose tray 14, a multipurpose sheet supply mechanism 15, and a multipurpose transport roller 16. The multipurpose sheet supply mechanism 15 is for supplying sheets 3 that are stacked on the multipurpose tray 14.

The multipurpose sheet supply mechanism 15 includes a multipurpose sheet supply roller 15*a*, a multipurpose separation pad 15*b*, and a spring 15*c*. The multipurpose separation pad 15*b* is disposed in confrontation with the multipurpose sheet supply roller 15*a*. The spring 15*c* is disposed to the underside of the multipurpose separation pad 15*b*. The urging force of the spring 15*c* presses the multipurpose separation pad 15*b* against the multipurpose sheet supply roller 15*a*.

The multipurpose sheet supply mechanism 15 operates in a manner similar to the sheet feed mechanism 7. That is, rotation of the multipurpose sheet supply roller 15*a* pinches the uppermost sheet 3 of the stack on the multipurpose tray 14 between the multipurpose sheet supply roller 15*a* and the multipurpose separation pad 15*b*. Then, cooperative operation between the multipurpose sheet supply roller 15*a* and the multipurpose separation pad 15*b* separates one sheet 3 at a time from the stack and supplies them toward the registration rollers 11.

The image forming section 5 includes a scanner section 17, a process section 18, a fixing section 19. The scanner section 17 is provided at the upper section of the casing 2 and is provided with a laser emitting section (not shown), a rotatingly driven polygon mirror 20, lenses 21*a* and 21*b*, and a reflection mirror 22. The laser emitting section emits a laser beam based on desired image data. As indicated by two-dot chain line in FIG. 1, the laser beam passes through or is reflected by the polygon mirror 20, the lens 21*a*, the reflection mirror 22, and the lens 21 in this order so as to irradiate, in a high speed scanning operation, the surface of the photosensitive drum 23 of the process section 18.

The process section 18 is disposed below the scanner section 17 and is freely detachable from and attachable to the casing 2. The process section 18 includes the development cartridge 24 and a drum cartridge 38. The development cartridge 24 is freely detachable from and attachable to the drum cartridge 38. It should be noted that the development cartridge 24 is detachable from the drum cartridge 38 both while the drum cartridge 38 is mounted in the casing 2 and while the drum cartridge 38 is removed from the casing 2.

Figure 2:
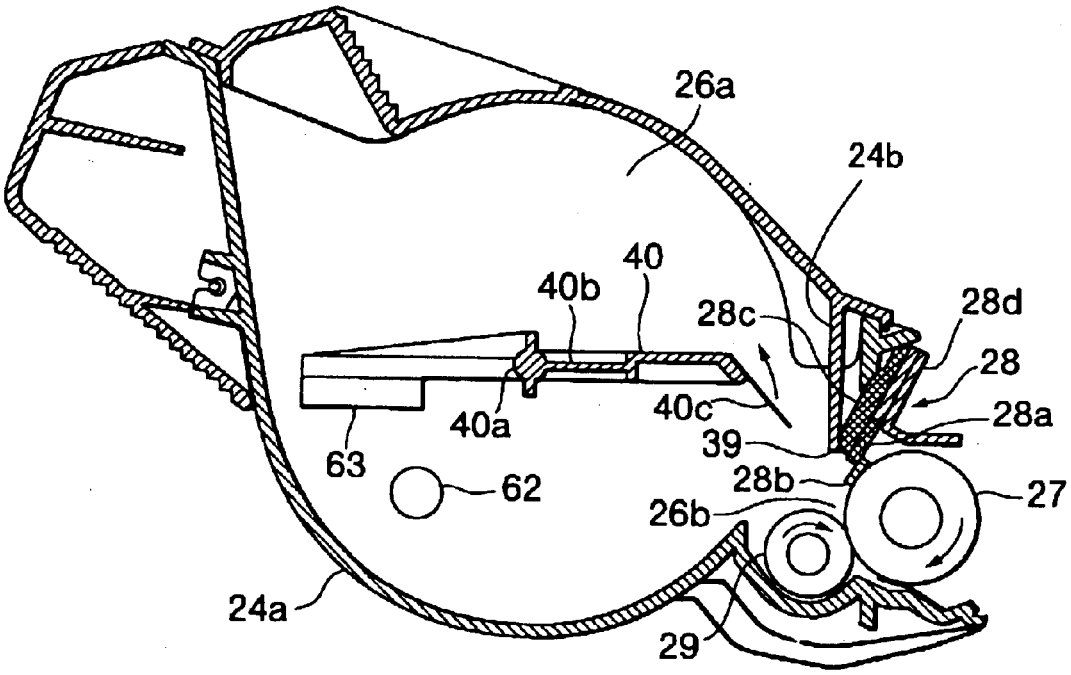
FIG. 2 is a cross-sectional side view showing essential elements of the developing cartridge of the laser printer shown in FIG. 1.

As shown in FIG. 2, the development cartridge 24 includes a casing 24*a*, an agitator 40, a supply roller 29, a developing roller 27, and a layer thickness regulating blade 28.

The casing 24*a* of the development cartridge 24 is sectioned into a toner chamber 26*a* and a developing chamber 26*b* by a partition wall 24*b*. The toner chamber 26*a* is filled with positively charging, non-magnetic, single-component toner. The partition wall 24*b* between the toner chamber 26*a* and the developing chamber 26*b* is formed with a toner supply opening 39 that brings the toner chamber 26*a* and the developing chamber 26*b* into fluid communication. The developing chamber 26*b* houses the supply roller 29, the developing roller 27, and the layer thickness regulating blade 28.

The agitator 40 includes a rotation shaft 40*a*, an agitation blade 40*b*, a film member 40*c*, and a cleaner 63. The rotation shaft 40*a* is rotatably supported at the center of the toner chamber 26*a*. The agitation blade 40*b* is provided along the length of the rotation shaft 40*a*. The film member 40*c* is adhered to the free end of the agitation blade 40*b*. The cleaner 63 is provided on the opposite side of the rotation shaft 40*a* than the agitation blade 40*b*.

The rotation shaft 40*a* is driven to rotate by a gear mechanism 59 to be described later. Rotation of the rotation shaft 40*a* rotates the agitation blade 40*b* so that the film member 40*c* scrapes toner in the toner chamber 26*a* up into the developing chamber 26*b*. As the agitation blade 40*b* rotates, the cleaner 63 wipes toner from windows 62 to be described later.

The supply roller 29 is rotatably disposed below the toner supply opening 39. The supply roller 29 includes a metal roller shaft and a sponge member. The sponge member is made from an electrically conductive sponge material and covers the roller shaft.

The developing roller 27 is rotatably disposed to the side of the supply roller 29. The supply roller 29 and the developing roller 27 are disposed in abutment with each other so that both are compressed to a certain extent. The developing roller 27 includes a metal roller shaft and a resilient cover member. The resilient cover member is formed from an electrically conductive resilient material and covers the roller shaft. The resilient cover member may be made from conductive silicone rubber or urethane rubber dispersed with, for example, carbon particles to provide it with electrical conductivity. The resilient cover member is coated with a layer of silicone rubber or urethane rubber that contains fluorine. The developing roller 27 is applied with a predetermined developing bias to develop a potential difference with respect to the photosensitive drum 23.

The layer thickness regulating blade 28 is disposed above the developing roller 27 and contacts the developing roller 27 along the axial length of the developing roller 27. The layer thickness regulating blade 28 includes a spring member 28*a*, a pressing member 28*b*, a back up member 28*c*, and a support member 28*d*. The support member 28*d* is connected to the case 24*a*. The support member 28*d* is connected at its lower end to the spring member 28*a* and so supports the spring member 28*a* on the case 24*a*. The back up member 28*c* is attached to the opposite side of the support member 28*d* and the spring member 28*a* than case 24*a* and generates a pressing force on the back of the spring member 28*a*. The spring member 28*a* is connected at its lower free end to the pressing member 28*b* and so supports the spring member 28*a*. The pressing member 28*b* is formed from electrically-insulating silicone rubber in a half-circle shape when viewed in cross section. Resilient force of the spring member 28*a* maintains the pressing member 28*b* in contact with the developing roller 27. It should be noted that because the pressing member 28*b* of the layer thickness regulating blade 28 is formed from silicone rubber, the toner borne on the developing roller 27 will be properly charged.

Figure 3:
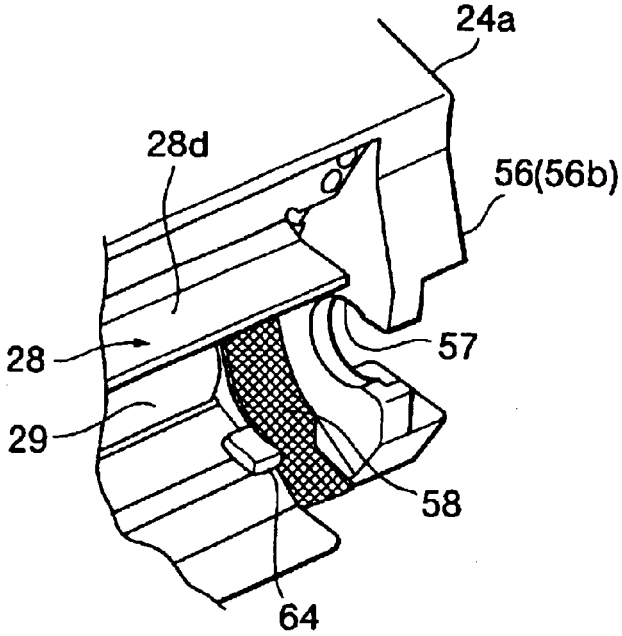
FIG. 3 is a perspective view showing essential elements in the vicinity of side seals at axial ends of a developing roller in the developing cartridge of FIG. 2.

As shown in FIG. 2, the development cartridge 24 is open at the side where the developing roller 27 is mounted on the casing 24*a*. FIG. 3 shows configuration of the casing 24*a* and other components around one axial end of the developing roller 27, with the developing roller 27 itself omitted to facilitate explanation. Although FIG. 3 shows configuration around only one axial end of the developing roller 27, the same configuration around both axial ends of the developing roller 27.

As shown in FIG. 3, configuration around the axial ends of the developing roller 27 includes side walls 56 of the casing 24*a*, and side shields 58, and lower side shields 64. The side walls 56 include a side wall 56*a* and a side wall 56*b*. Each side wall 56 is formed with a support hole 57, which is an open groove that is continuous with the open side of the corresponding side wall 56. The support holes 57 are for mounting the roller shaft of the developing roller 27 from the open side of the casing 24*a*. Each side shield 58 is formed from a felt member adhered on a sponge member adhered to the inside of and adjacent to the corresponding side wall 56. The side shields 58 serve as seal members for preventing toner from leaking around the axial ends of the developing roller 27. Axial ends of the developing roller 27 are slidably disposed on the side shields 58. Each lower side shield 64 is adhered to the inner side of each side shield 58.

The lower side shields 64 are for preventing toner from leaking out from the toner chamber 26*a* in the same manner as the side shields 58.

Figures 4A, 4B, 4C:
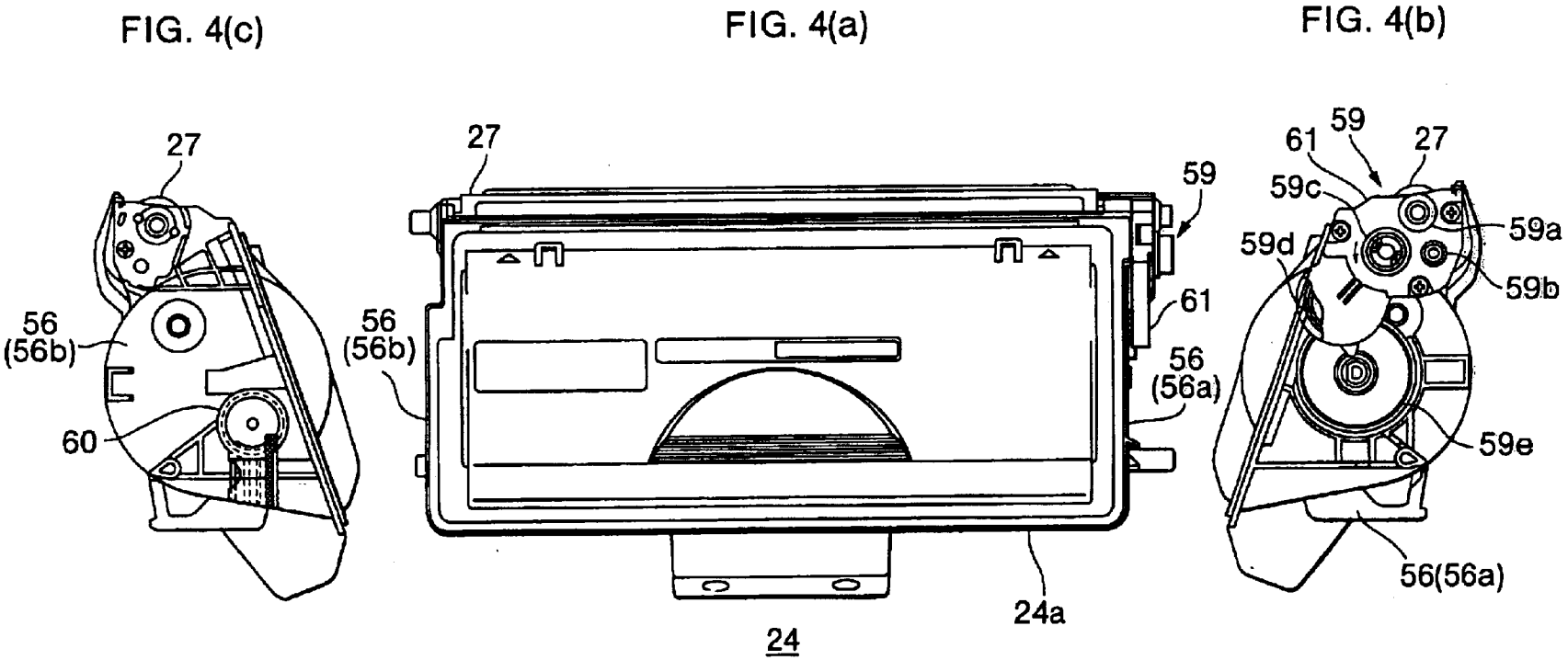
FIG. 4(*a*) is a plan view showing the developing cartridge of FIG. 2.

As shown in FIG. 4(*a*), a gear mechanism 59 is provided on the side wall 56*a* and a toner cap 60 is provided on the other side wall 56*b*. The gear mechanism 59 is for driving various components such as the developing roller 27 and the agitator 40. The toner cap 60 is for enabling access to the toner chamber 26*a* when the toner cap 60 is opened up.

The gear mechanism 59 includes a holder plate 61 and a variety of gears 59*a* to 59*e*. The holder plate 61 is supported on the side wall 56*a* and the gears 59*a* to 59*e* are rotatably supported on the holder plate 61. As shown in FIG. 4(*b*), the gears 59*a* to 59*e* include a developing roller drive gear 59*a*, a supply roller drive gear 59*b*, a first intermediate gear 59*c*, a second intermediate gear 59*d*, and an agitator drive gear 59*e*. The developing roller drive gear 59*a* is connected to the roller shaft of the developing roller 27. The supply roller drive gear 59*b* is connected to the roller shaft of the supply roller 29. The first intermediate gear 59*c* is meshingly engaged with the developing roller drive gear 59*a* and the supply roller drive gear 59*b*. The second intermediate gear 59*d* is meshingly engaged with the first intermediate gear 59*c*. The agitator drive gear 59*e* is meshingly engaged with the second intermediate gear 59*d* and is connected to the rotation shaft 40*a* of the agitator 40.

Although not shown in the drawings, a motor for driving the gears 59*a* to 59*e* is mounted in the laser printer 1. While the development cartridge 24 is mounted in the laser printer 1, the drive force of the motor is transmitted to the first intermediate gear 59*c* to rotate the first intermediate gear 59*c* in the counterclockwise direction of FIG. 4(*b*) as indicated by an arrow in FIG. 4(*b*). As a result, the supply roller 29 and the developing roller 27 are driven to rotate in the clockwise direction of FIG. 2 through the developing roller drive gear 59*a* and the supply roller drive gear 59*b*, respectively. Also, the agitator 40 is driven to rotate through the second intermediate gear 59*d* and the agitator drive gear 59*e*.

The toner cap 60 shown in FIG. 4(*c*) is for opening and closing an opening formed in the side wall 56*b*. The toner chamber 26*a* can be accessed through the opening when the toner cap 60 is removed. As will be described in greater detail later, once the development cartridge 24 runs out of toner, any previously-used toner that remains in the toner chamber 26*a* is emptied out of the toner chamber 26*a* through the opening. Then the toner chamber 26*a* is refilled with toner, also through the opening in the side wall 56*b*. It should be noted that "previously-used toner" refers to toner that was used during development operations before the toner chamber 26*a* is refilled with fresh toner.

As the agitator 40 rotates in the counterclockwise direction as viewed in FIG. 2, the agitator 40 agitates the toner in the toner chamber 26*a* and transports the toner from the toner supply opening 39 to the developing chamber 26*b*. Also at this time, the cleaners 63 supported on the agitator 40 clean the windows 62 that are formed in the side walls 56. The windows 62 are used for detecting residual amount of toner. That is, the windows 62 enable light from an optical sensor (not shown) to pass through the side wall 56. Light from the optical sensor does not pass through the windows 62 when the toner chamber 26*a* is full of toner. However, light from the optical sensor does pass through the windows 62 when the amount of residual toner in the toner chamber 26*a* drops to a small amount. When light from the optical sensor passes through the windows 62, a light receiving portion of the optical sensor picks up the light and so detects that the development cartridge has run out of toner. This is indicated on a control panel (not shown) provided on the casing 2.

As the supply roller 29 rotates, the supply roller 29 supplies toner that was fed through the toner supply opening 39 to the developing chamber 26*b* further to the developing roller 27. At this time, the toner is triboelectrically charged to a positive charge between the supply roller 29 and the developing roller 27. As the developing roller 27 rotates, the toner on the developing roller 27 enters between developing roller 27 and the pressing member 28*b*, and is smoothed down to a thin layer of uniform thickness on the developing roller 27.

As shown in FIG. 1, the drum cartridge 38 includes the transfer roller 25, the photosensitive drum 23, and a scorotron charge unit 37. The photosensitive drum 23 is disposed at the side of and in contact with the developing roller 27 while the development cartridge 24 is attached to the drum cartridge 38. The photosensitive drum 23 is rotatable in the counterclockwise direction as indicated by an arrow in FIG. 1. The photosensitive drum 23 is connected to ground. A photosensitive layer covers the surface of the photosensitive drum 23. The photosensitive layer is made from polycarbonate and has a positively charging nature.

The scorotron charge unit 37 is disposed above the photosensitive drum 23 at a position separated from the photosensitive drum 23 by a predetermined space, so that the scorotron charge unit 37 does not touch the photosensitive drum 23. The scorotron charge unit 37 is a positive-charge scorotron type charge unit for generating a corona discharge from a charge wire made from, for example, tungsten, to form a blanket of positive-polarity charge on the surface of the photosensitive drum 23.

An electrostatic latent image based on desired image data is formed on the photosensitive drum 23 in the following manner. First, the scorotron charge unit 37 forms a blanket of positive charge on the surface of the photosensitive drum 23 as the photosensitive drum 23 rotates. Then, the laser beam from the scanner section 17 scans across the surface of the photosensitive drum 23 at a high speed. At this time, the laser beam is driven according to the desired image data to selectively expose the charged surface of the photosensitive drum 23. Exposed portions of the charged surface experience a drop in electric potential. The areas of lower electric potential are the electrostatic latent image on the surface of the photosensitive drum 23.

The electrostatic latent image is developed by an inverse developing process. That is, as the developing roller 27 rotates, the positively-charged toner borne on the surface of the developing roller 27 is brought into contacting confrontation with the photosensitive drum 23. At this time, the toner on the developing roller 27 is supplied to the electrostatic latent image on the rotating photosensitive drum 23. As a result, the toner is selectively borne on the photosensitive drum 23 so that the electrostatic latent image is developed into a visible toner image.

The transfer roller 25 is rotatably supported at a position below and in confrontation with the photosensitive drum 23. The transfer roller 25 is made from a metal roller shaft covered by an electrically-conductive rubber roller. To transfer the visible toner image from the photosensitive drum 23 to a sheet 3, the transfer roller 25 is applied with a predetermined transfer bias so that an electric potential difference develops between the transfer roller 25 and the photosensitive drum 23. As rotation of the photosensitive drum 23 and the transfer roller 25 conveys a sheet 3 between the photosensitive drum 23 and the transfer roller 25, the electric potential difference shifts the visible toner image from the photosensitive drum 23 to the sheet 3. The sheet 3, which is now formed with the visible toner image, is next transported to the fixing section 19 by a transport belt 30.

The fixing section 19 is disposed downstream from the process section 18 and includes a thermal roller 31, a pressing roller 32, and transport rollers 33. The pressing roller 32 presses against the thermal roller 31. The thermal roller 31 includes a metal tube and a halogen lamp. The halogen is disposed inside the metal tube in order to heat up the metal tube. The thermal roller 31 thermally fixes the visible toner image on the sheet 3 as rotation of the thermal roller 31 and the pressing roller 32 transports the sheet 3 between the thermal roller 31 and the pressing roller 32. The transport rollers 33 are provided downstream from the thermal roller 31 and the pressing roller 32.

Transport rollers 34 and discharge rollers 35 are rotatably provided on the casing 2 at positions downstream from the transport rollers 33 of the fixing section 19. The transport rollers 34 transport the sheet 3 from the transfer rollers 33 to the discharge rollers 35. The developing rollers 35 then discharge the sheet 3 onto a sheet discharge tray 36 at the upper side of the casing 2.

The laser printer 1 uses a "cleanerless development method," wherein the developing roller 27 is used to collect residual toner from the photosensitive drum 23 after the visible toner image is transferred from the photosensitive drum 23 onto the sheet 3. The cleanerless development method reduces the number of components required to collect residual toner from the photosensitive drum 23. For example, no blade or other such member needs to be provided for removing the residual toner. Also, no accumulation tank needs to be provided for holding the waste toner. Therefore, the configuration of the laser printer can be simplified.

The retransport unit 41 includes an inverting mechanism 42, a flapper 45, and a retransport tray 43. The inverting mechanism and the retransport tray 43 are formed integrally together, and mounted onto the casing 2 by attaching the inverting mechanism 42 to the rear side of the casing 2 while the retransport tray 43 is inserted into the casing 2 at a position above the feeder section 4.

The inverting mechanism 42 includes a casing 44, inversion rollers 46, retransport rollers 47, and an inversion guide plate 48. The casing 44 has a substantially rectangular shape when viewed in cross section as in FIG. 1. The inversion rollers 46 and the retransport rollers 47 are disposed in the casing 44. The inversion guide plate 48 protrudes upward from the upper portion of the casing 44.

The flapper 45 is pivotably provided in the laser printer 1 at a position downstream from and adjacent to the transport rollers 33. The flapper 45 is for selectively switching transport direction of sheets 3 to either toward the transport rollers 34 as indicated by solid line in FIG. 1 or toward the inversion rollers 46 as indicated by broken line in FIG. 2. Although not shown in the drawings, a solenoid is provided for switching orientation of the flapper 45.

The inversion rollers 46 are disposed at a position that is downstream from the flapper 45 and in the upper portion of the casing 44. The inversion rollers 46 can be selectively driven in either a forward or reverse direction. The inversion rollers 46 rotate in the forward direction to transport a sheet 3 toward the inversion guide plate 48 and then rotate in the reverse direction to transport the sheet 3 downward from the inversion guide plate 48.

The inversion guide plate 48 is formed from a plate-shaped member that extends upward from the upper end of the casing 44 and serves to guide sheets that are transported upward by the inversion rollers 46.

The retransport rollers 47-are disposed at a position almost directly beneath the inversion rollers 46. The retransport rollers 47 transport sheets 3 from the inversion rollers 46 to the retransport tray 43.

When a sheet 3 is to be formed with images on both surfaces, first the solenoid (not shown) is energized to switch the flapper 45 into the position for guiding the sheet 3 from the image forming section 5 toward the inversion rollers 46. As a result, after the image forming section 5 forms an image on one side of a sheet 3, the sheet 3 is guided from the transport rollers 33 into the inverting mechanism 42. At this time, the inversion rollers 46 are rotated forward. As a result, when the received sheet 3 reaches the inversion rollers 46, the sheet 3 is sandwiched between the inversion rollers 46 and transported upward following the inversion guide plate 48. Once most of the sheet 3 is transported upward out from the casing 44 and only the rear side end is sandwiched between the inversion rollers 46, then forward rotation of the inversion rollers 46 is stopped and the inversion rollers 46 are rotated in reverse. As a result, the sheet 3 is transported, with its upper and lower surfaces reversed, almost directly downward to the retransport rollers 47. The retransport rollers 47 transport the sheet 3 to the retransport tray 43.

It should be noted that a sheet passage sensor 70 is provided downstream from the fixing section 19. The timing at which the inversion rollers 46 is switched from forward to reverse rotation is controlled to the time after a predetermined duration of time elapses from when the sheet passage sensor 70 detects the trailing edge of the sheet 3. Further, once the sheet 3 has been transported to the inversion rollers 46, the flapper 45 switches to its initial position, that is, to the position for sending sheets from the transport rollers 33 to the transport rollers 34.

The retransport tray 43 includes a sheet supply portion 49, a tray 50, two sets of oblique rollers 51, and a retransport pathway 53. The sheet supply portion 49 includes an arc-shaped sheet guide member 52 and is detachably attached to the rear end of the casing 2 at a position below the inverting mechanism 42.

The tray 50 is a substantially rectangular-shaped plate and is provided in a substantially horizontal orientation at a position above the sheet supply tray 6. The upstream end of the tray 50 is a continuation of the sheet guide member 52.

The two sets of oblique rollers 51 are disposed along the tray 50 and separated by a predetermined space in the direction in which sheets 3 is transported. Although not shown in the drawings, a reference plate is provided along one widthwise edge of the tray 50. Each set of oblique rollers 51 includes an oblique drive roller 54 and an oblique follower roller 55. Each oblique drive roller 54 is disposed near the reference plate (not shown) with the imaginary rotation axis of the oblique drive roller 54 extending in a direction that is substantially perpendicular to the direction in which the sheet 3 are transported. Each oblique follower roller 55 is disposed in confrontation with the corresponding oblique drive roller 54 so that sheets 3 are transported in a condition sandwiched therebetween. Each oblique follower roller 55 is disposed so that its imaginary rotational axis extends at a slant from the direction that is substantially perpendicular to the transport direction of sheets 3. Because the oblique follower rollers 5 are disposed with this slanted orientation, sheets 3 transported by the oblique rollers 51 tend to move toward the reference plate (not shown).

The upstream end of a retransport pathway 53 is continuous with the downstream end of the tray 50. Further, the downstream end of the retransport pathway 53 is connected to a midway section of the sheet transport pathway 65.

The sheet guide member 52 guides each sheet 3 that was transported substantially vertically down from the retransport rollers 47 of the inverting mechanism 42 to sheet supply portion 49 into a substantially horizontal orientation and in the direction of the tray 50. The oblique rollers 51 transport the sheet 3 along the tray 50 while abutting the widthwise edge of the sheet 3 against the reference plate, and then through the retransport pathway 53 to the second transport rollers 10. Next, the second transport rollers 10 transport the sheet 3 once again toward the image forming position between the transfer roller 25 and the photosensitive drum 23 of the drum cartridge 38. At this time, the sheet 3 is upside down (upper and lower surfaces reversed) compared to the first time an image was formed on the sheet 3. Therefore, a visible toner image is transferred from the photosensitive drum 23 onto the opposite surface of the sheet 3 than was formed with an image the previous time. Next, the fixing section 19 fixes the visible toner image onto the sheet 3 and the sheet 3, which now has images formed on both of its surfaces, is discharged onto the discharge tray 36.

When the development cartridge 24 runs out of toner, the development cartridge 24 is refilled with toner and reused instead of merely being replaced and discarded. It should be noted that in the following description, "reusage" of an development cartridge 24 means using the development cartridge 24 again for development operations after most or all of the toner in the development cartridge 24 has been used up during a preceding development operation usage while mounted in the laser printer 1.

Next, a method of refilling the development cartridge 24 will be described. Before refilling the development cartridge 24, it is necessary to determine the type of toner that filled the toner chamber 26*a* during the preceding development operation usage of the development cartridge 24. This could be achieved by investigating the type of toner used in the specific model of development cartridge 24.

In the present example, it is determined that during the preceding development operation usage the toner chamber 26*a* of the development cartridge 24 was filled with suspension polymerization toner having the following properties. Suspension polymerization toner is one type of polymerization toner. Suspension polymerization toner has substantially spherical particles, and so has excellent fluidity.

To produce suspension polymerization toner, a polymerizing monomer is dissolved or dispersed in a polymerizing medium along with a polymerization initiator and a coloring agent, such as carbon black. A cross linking agent, a charge controlling agent, or some other additive may also be added as needed. Examples of the polymerizing monomer include a styrene type monomer or an acrylic type monomer. An example of a styrene type monomer is styrene. Examples of acrylic type monomers are acrylic acid, alkyl (C1–C4) acrylate, and alkyl (C1–C4) methacrylate. Suspension polymerization is effected while agitating and dispersing the mixture in an aqueous phase to produce suspension polymerization toner with an average particle diameter of about 6 to 10 microns.

The fluidity characteristic of the suspension polymerization toner is about 90 or greater. Fluidity characteristic is a value measured using a powder tester PTR produced by the Hosokawa Micron Group. The powder tester PTR includes three sieve levels. Each sieve level has a different mesh gauge. The first sieve level has a mesh gauge of 150 microns. The second sieve level has a mesh gauge of 75 microns. The third sieve level has a mesh gauge of 45 microns. To measure the fluidity characteristic, 4 g of toner is introduced into first sieve level of the tester PTR. Then, all three sieve levels of the tester are applied with a fixed vibration for a fixed duration of time, such as 15 seconds. Afterward, the toner that remains in each sieve level is weighed and the fluidity calculated using the following equation:

$$\text{fluidity characteristic} = X1 \times X2 \times X3, \text{ wherein:}$$

X1=weight of toner remaining on first sieve level/4 g×100,
X2=weight of toner remaining on second sieve level/4 g×100×3/5, and
X3=weight of toner remaining on third sieve level/4 g×100×1/5

It should be noted that fluidity characteristic tends to improve in accordance with increase in external additive coating rate, as is known from the disclosure of "Collection of Papers presented at the 39th Symposium on Powder Science and Technology," pages 109 to 113. The 39th Symposium on Powder Science and Technology was held in Hiroshima, Japan, from November 11 to 17, 2001. In the present example, the suspension polymerization toner that filled the development cartridge 24 during the preceding development operation usage further includes external additive in order to enhance the toner's fluidity characteristic. The external additive is a powder with smaller particle size than the base toner particles and covers the base toner particles of the suspension polymerization toner at a coverage rate of 60% to 120%. Examples of external additive include silica, titanium oxide, and alumina.

When the laser printer 1 indicates that the development cartridge 24 has run out of toner, then the user detaches the used development cartridge 24 from the laser printer 1. After determining that the type of previously-used toner that remains in the toner chamber 26*a* from the preceding developing operation usage is suspension polymerization toner, the user then designates the toner to be used to refill the toner chamber 26*a*. According to the first embodiment, the refill toner should have a lower fluidity characteristic than the previously-used toner. In the present example, it is desirable that the refill toner also have a fluidity characteristic that is higher than the fluidity characteristic of pulverized toner that has not been subjected to globular formized processing. Pulverized toner that has been subjected to globular formized processing will be referred to as globular formized, pulverized toner, hereinafter. Further, it is desirable that the refill toner have a fluidity characteristic of from 60 to 85, and preferably from 70 to 80.

In the present example, the user designates one of the following toners instead of the suspension polymerization toner that was used in the development cartridge 24 during the preceding developing operation usage. That is, the development cartridge 24 may be refilled with a suspension polymerization toner containing a smaller amount of external additive than the amount of external additive contained in the suspension polymerization toner that was used in the development cartridge 24 during the preceding developing operation usage. Alternatively, the development cartridge 24 may be refilled with emulsion polymerization toner. As a further alternative, the development cartridge 24 may be refilled with globular formized, pulverized toner.

Because in this example the residual suspension polymerization toner from the preceding developing operation usage has an external additive coating rate of 60% to 120%, an example of a suspension polymerization toner containing a smaller amount of external additive is a toner with an external additive coating rate of 20% to 50%. Also, suspension polymerization toner containing external additive at this rate has a fluidity characteristic of 75 to 85, which is within the desirable range of 60 to 85 described above.

Emulsion polymerization toner is another type of polymerization toner. The particles of emulsion polymerization toner have optional shapes, that is, from nearly spherical to irregular shapes. The emulsion polymerization toner is produced by dissolving or dispersing the above-described polymerizing monomer(s) in a polymerizing medium along with a polymerization initiator, a coloring agent, and, as needed, a cross linking agent, a charge controlling agent, or some other additive. Next, this mixture is agitated to emulsify in an aqueous environment that contains a surfactant. The emulsion polymerization toner has an average particle size of about 6 to 10 microns In the same manner as described above for the suspension polymerization toner from the preceding development operation usage, the emulsion polymerization toner includes the above-described external additive(s) to the toner core particles in order to improve the fluidity characteristic. As with the suspension polymerization toner from the preceding development operation usage, the external additive is added to the emulsion polymerization toner to result in a coverage rate of from 60% to 120%. The emulsion polymerization toner in this example has a fluidity characteristic of from 70 to 85.

Spheronized, pulverized toner is a toner with irregular shaped particles, but with better fluidity than pulverized toner that has not been subjected to globular formized processes. Pulverized toner that has not been subjected to globular formized processing will be referred to as non-globular-formized pulverized toner, hereinafter. To produce the globular formized, pulverized toner, first non-globular-formized pulverized toner is obtained by adding a coloring agent, such as carbon black, to a binding resin and kneading the binding resin until the coloring agent is dispersed throughout the binding resin. The binding resin can be made from a natural resin or a synthetic resin. Once cured, the mixture is pulverized and classified to form the pulverized toner. The pulverized toner is then subjected to globular formized processes using a Mechanofusion AMS produced by the Hosogawa Micron Group to obtain the globular formized, pulverized toner. In this case, the globular formized, pulverized toner has an average particle diameter of about 6 to 10 microns and a fluidity characteristic of 60 to 70. Alternatively, the pulverized toner may be subjected to globular formized processes using heat processing. In this case, the resultant globular formized, pulverized toner has an average particle diameter of about 6 to 10 microns and a fluidity characteristic of from 70 to 80.

Once the type of refill toner has been designated, the user opens the toner cap 60 to access the toner chamber 26*a* through the opening in the side wall 56*b* and performs a cursory cleaning of the toner chamber 26*a*. That is, the user extracts previously-used toner from inside toner chamber 26*a* until 1.2 g/cm or less, and preferably 0.7 g/cm or less, remains in the toner chamber 26*a* per axial direction length of the developing roller 27.

Next, the development cartridge 24 is refilled with one of the above-described toners through the opening in the side wall 56*b*. At this time, the amount of refill toner should be eight times or greater than the amount of toner remaining from the previous usage of the development cartridge 24. Then, the opening is closed up by replacing the toner cap 60. This ends the toner refilling operation. After the development cartridge 24 is refilled with toner as described above, the development cartridge 24 is again mounted in the laser printer 1 and reused to perform image development processes.

During the preceding development operation usage of the development cartridge 24, the developing roller 27 slides against and abrades the side seals 58 as the developing roller 27 rotates. This wears down the side seals 58 so that their sealing properties declines. If the development cartridge 24 were refilled with the same type of toner as used during the preceding development operation usage of the development cartridge 24, then toner would leak from between the side seals 58 and the developing roller 27. Consequently, toner would leak outside of the development cartridge 24 when the development cartridge 24 was reused for subsequent development operations.

However, such leaks can be prevented when the development cartridge 24 is refilled with toner that has a lower fluidity characteristic as described above. Further, a cursory cleaning of the development cartridge 24 suffices. The side seals 58 need not be exchanged, so the costs and trouble of replacing the side seals 58 can be dispensed with.

Also, because the toner cap 60 is provided on the opposite side of the casing 24*a* than the gear mechanism 59, the previously-used toner can be removed, such as by shaking or suctioning the development cartridge 24, without dirtying the gear mechanism 59. Moreover, the development cartridge 24 can be refilled without dirtying the gear mechanism 59. Therefore, the developing roller 27, the supply roller 29, and the agitator 40 will all operate reliably when the development cartridge 24 is reused after the holding chamber 26*a* is refilled with toner.

Further, fogging can be prevented because the previously-used toner is extracted from inside the toner chamber 26*a* until 1.2 g/cm or less, and preferably 0.7 g/cm or less, remains in the toner chamber 26*a* per axial direction length of the developing roller 27. That is, if the used developing cartridge 24 were refilled with toner while a great deal of toner remained from the preceding development operation usage, then image fogging could occur when forming images during the reuse of the developing cartridge 27. However, because previously-used toner is extracted from inside the toner chamber 26*a* until 1.2 g/cm or less, and preferably 0.7 g/cm or less, remains in the toner chamber 26*a* per axial direction length of the developing roller 27, even if toner is refilled while toner that was used during the previous usage of the development cartridge 24 still remains in the development cartridge 24, image fogging can be prevented from occurring during image formation when the development cartridge 24 is reused. Proper image formation can be achieved during reuse of the development cartridge 24. Moreover, because this method allows some toner to remain from the preceding developing operation usage, there is no need to disassemble and clean out the development cartridge 24 to completely remove previously-used toner. Therefore, toner refill operations can be easily and efficiently performed. Costs can also be reduced.

Further, image fogging during image formation is even more reliably prevented because the amount of refill toner is eight times or greater than amount of toner remaining from previous usage of the development cartridge 24.

Because polymerization toner has excellent fluidity, it can be easily removed to the desired quantity, for example by shaking the toner out from the opening in the side wall 56*b*. Therefore, image fogging can be easily prevented from occurring in image formation during reuse of the development cartridge 24. Also, by refilling the development cartridge 24 with polymerization toner, high-quality image formation can be achieved because of the good fluidity characteristic of the polymerization toner. As a result, image fogging can be prevented during reuse of the development cartridge 24 and high quality images can be formed.

Experiments were performed to check levels of fogging that occurred when different amounts of previously-used toner remain from previous usage of the development cartridge 24. Table 1 shows results of the experiments. The development cartridges 24 used in these experiments each included a toner chamber 26*a* that had a length in the axial direction of the developing roller 27 of 221.0 mm and that had an average cross-sectional area (along the axial length of the developing roller 27) of 3,787.9 mm. The development cartridges 24 when in a new condition were first used for developing operations until toner ran out. Then, the previously-used toner from this preceding usage was removed to gram per centimeter (in length of toner chamber 24*a*) amounts shown in Table 1. Next, the development cartridges 24 were refilled with 190 g of toner in the manner described above. In each test, eight times or more toner than the amount of previously-used toner was refilled into the development cartridges 24. Then the development cartridges 24 were remounted into the laser printer 1 and printing evaluations performed.

TABLE 1

| | | | | |
|---|---|---|---|---|
| RESIDUAL AMOUNT PER UNIT LENGTH (g/cm) | 0.7 | 1.2 | 1.6 | 2.1 |
| FOGGING EVALUATION | A | B | C | D |

A: No toner remained on the photosensitive drum so images had good quality.
B: Some toner remained on the photosensitive drum, but could not be seen in the printed image.
C: Enough toner remained on the photosensitive drum to be slightly visible in the printed image.
D: Toner remained on the photosensitive drum and could also be seen in the printed image.

It should be noted that the evaluations noted in Table 1 were made by observing the surface of the photosensitive drum 23 and the image quality of the first sheet 3 printed after refill. Also, because the development cartridges 24 used in these experiments have the above-described dimensions, 0.7 g/cm (in length of toner chamber 24*a*) equals about 15.47 g of previously-used toner and 1.2 g/cm (in length of toner chamber 24*a*) equals about 26.52 g of previously-used toner. To contain the residual previously-used toner (15.47 g) and also the refill toner (190*g*), then the toner chamber 24*a* needs to be capable of holding 205.47 g or more toner. Assuming that the toner has a sifted density (density in a freshly sifted condition) of 0.5 g/cc, then the toner chamber 24*a* needs to have a toner holding capacity of about 411 cc (205.47/0.5=41 cc).

From Table 1, it can be understood that fogging can be prevented by removing previously-used toner from inside the toner chamber 26*a* until 1.2 g/cm or less, and preferably 0.7 g/cm or less, remains in the toner chamber 26*a* per axial direction length of the developing roller 27.

It should be noted that the used developing roller 27 may be replaced with a new developing roller 27' before the holding chamber 26*a* is refilled with toner. The used developing roller 27 can be easily detached by detaching the shaft ends of the developing roller 27 from the support holes 57. Then, the shaft ends of the new developing roller 27' are aligned in the support holes 57 and the new developing roller 27' moved following the groove-shape of the support holes 57 to a position against the side seals 58. It is desirable to replace the developing roller 27 with the new developing roller 27' because this insures that the refill toner is properly carried to the photosensitive drum 23 during subsequent developing operations using the refill toner. Subsequent development operations by the development cartridge 24 will produce high quality images.

Before replacing the used developing roller 27, it is desirable to determine the toner bearing capacity of the used developing roller 27 and replace it with a new developing roller 27' that has a lower toner bearing capacity. The toner bearing capacity represents the amount of toner that a developing roller can bear per unit surface area and is indicated by the mass M of toner per unit of toner-supporting surface area A of the developing roller (M/A). Because the new developing roller 27' has a lower toner bearing capacity than the used developing roller 27, it will bear less toner per unit surface area (M/A) than the used developing roller 27. Therefore, toner can be prevented from leaking out from the development cartridge 24 between the side seal 58 and the developing roller 27 when the development cartridge 24 is reused.

Here are two examples of new developing rollers 27' with lower toner bearing capacity than the used developing roller 27. In the first example, the developing roller 27' has a lower surface roughness than the surface roughness of the used developing roller 27. More specifically, the developing roller 27 has a surface roughness (ten-point average roughness Rz) of 5 to 7 microns and the new developing roller 27' has a surface roughness (ten-point average roughness Rz) of 2 to 3 microns. In the second example, the new developing roller 27' has a harder surface than the developing roller 27. More specifically, the developing roller 27 has a hardness (Japanese Industrial Standard A) of 30 to 50 degrees and developing roller 27' has a hardness of 50 degrees or greater.

Also, before replacing developing roller 27, it is desirable to determined the outer diameter of the developing roller 27 and designate another developing roller 27" with a larger outer diameter. Then, the developing roller 27 is replaced with the new developing roller 27" that has the larger outer diameter. In the first embodiment, the developing roller 27 has an outer diameter of 20.0 mm, and the new larger-diameter developing roller 27" has an outer diameter of 20.2 mm to 20.4 mm. When the developing roller 27 is replaced with the new larger-diameter developing roller 27", the developing roller 27" presses against surrounding components with a greater force. The larger pressing force of the developing roller 27" against the side seals 58 prevents toner from leaking between the developing roller 27" and the side seals 58. Also, the larger pressing force of the developing roller 27" against the pressing member 28*b* of the layer thickness regulating blade 28 reduces the mass M of developing agent per unit surface area A (M/A) of the developing roller 27. As a result, toner can be properly prevented from leaking out from the development cartridge 24 during reuse of the development cartridge 24.

Non-globular formized pulverized toner also has a lower fluidity characteristic than suspension polymerization toner. Therefore, by designating pulverized toner as the toner to refill the development cartridge 24 that was previously filled with suspension polymerization toner, toner can be prevented from leaking from the development cartridge 24 during subsequent development operation usage. However, the low fluidity characteristic of pulverized toner adversely affects the quality of images.

Therefore, as mentioned previously it is desirable that the development cartridge 24 be refilled with toner that has a fluidity characteristic higher than pulverized toner, or more specifically with a toner that has a fluidity characteristic of between 60 and 85, such as a suspension polymerization toner containing a smaller amount of external additive than the amount of external additive contained in the suspension polymerization toner that was used in the development cartridge 24 during the preceding developing operation usage, an emulsion polymerization toner, or a globular formized pulverized toner. This fluidity characteristic is not exceptionally high. Therefore, toner can be prevented from leaking from between the side seals 58 and the developing roller 27, even if the side seals 58 are not exchanged during the refill operation. Consequently, toner can be prevented from leaking outside of the development cartridge 24 when the development cartridge 24 is reused. Further, because the toner has a better fluidity characteristic than that of non-globular-formized pulverized toner, good image quality can be achieved.

Also, as described above the laser printer 1 uses a cleanerless development method wherein the developing roller 27. The cleanerless development method is only effective when small amounts of toner remain the photosensitive drum 23. That is, if a great deal of toner remains on the photosensitive drum 23 after image transfer, then the developing roller 24 might not be able to properly clean off the photosensitive drum 23.

However, when refill toner has a greater fluidity characteristic than the fluidity characteristic of non-globular-formized pulverized toner, only a small amount of toner will remain on the photosensitive drum 23. Therefore, proper cleanerless development can be achieved even during reuse of the development cartridge 24.

Experiments were performed to determine suitability of various toners for refilling the development cartridge 24 when suspension polymerization toner was used during the preceding development operation usage of the development cartridge 24. Before the experiments, a development cartridge 24 filled with suspension polymerization toner was used for developing operations until the toner ran out. The suspension polymerization toner that filled the development cartridges 24 had an external additive coating rate of 90% and a fluidity characteristic of 95. Then, the development cartridge 24 was refilled with one of the seven different types of toner indicated in Table 2. The developing cartridge 24 was then mounted in the laser printer 1 and reused to develop images on 6,000 sheets using 5% of the print duty of the printer 1. This experiment was repeated 10 times for each different type of toner, using a different development cartridge 24 for each repetition, that is, ten different cartridges 24 for each toner type, for a total of 70 development cartridges 24. The suitability of the different toners was judged based on the amount of toner leaking that was observed. The results of the experiments are shown in Table 2. In Table 2, the number of defective units refers to the number of development cartridges out of ten tested that showed toner leaks or distorted images.

| TYPE OF TONER | A | B | C | D | E | F | G |
|---|---|---|---|---|---|---|---|
| FEATURE | 90% COVER RATE | 40% COVER RATE | 90% COVER RATE | 45% COVER RATE | THERMAL PROC. | MECHANO-FUSION PROC. | NONE |
| FLUIDITY CHARACTER-ISTIC | 95 | 85 | 83 | 73 | 76 | 64 | 50 |
| NUMBER OF DEFECTIVE UNITS | 3 | 1 | 1 | 0 | 0 | 0 | 10 |
| EVALUATION | POOR[1] | GOOD[2] | GOOD[2] | GOOD[3] | GOOD[3] | GOOD[4] | POOR[5] |

A: Suspension polymerization toner (with higher external additive coating rate)
B: Suspension polymerization toner (with lower external additive coating rate)
C: Emulsion polymerization toner (with higher external additive coating rate)
D: Emulsion polymerization toner (with lower external additive coating rate)
E: Pulverized toner that was thermally globular formized
F: Pulverized toner that was globular formized by mechanafusion
G: Pulverized toner (not globular formized)
[1]Three of the ten developing cartridge leaked more than normal. The amount of leakage was small enough to enable reuse of the developing cartridge, but the toner was not ideally suited as a refill toner.
[2]One of the ten developing cartridge leaked more than normal. Only a small amount of toner leaked, not enough to prevent use of the developing cartridge.
[3]Almost no toner leakage.
[4]Images where slightly distorted. However, not enough to prevent usage.
[5]Images were obviously distorted after about 3,000 sheets. Afterward, the distortion was too severe to continue use.

As shown in Table 2, three out of the ten development cartridges 24 that were refilled with the same type of suspension polymerization toner as in the preceding developing operation usage showed greater amounts of toner leakage than compared with a new development cartridge 24.

On the other hand, only a slight amount of toner leaked from the developing cartridges 24 when the refill toner had a lower fluidity characteristic than the toner used the previous time. The toner leaked in amounts substantially the same as when a new development cartridge 24 was used. However, it should be noted that when non-globular-formized pulverized toner was used as the refill toner, then images printed by the laser printer 1 were distorted with vertical lines for ten out of the ten developing cartridges 24. Therefore, it was determined that non-globular-formized toner is inappropriate as a refill toner.

It should be noted that the pressing member **28*b* of the layer thickness regulating blade 28 of the development cartridge 24 is formed from silicone rubber and so is easily worn down by abrasion. Therefore, the durability of the layer thickness regulating blade 28 is greatly reduced when non-globular-formized pulverized toner is used as the refill toner. The refill toners according to the first embodiment have greater fluidity characteristic than pulverized toner. Therefore, the layer thickness regulating blade 28 will be abraded down to a lesser extent, so that image quality can be maintained during reuse of the development cartridge 24**.

The refilling method described above assumed that the toner chamber 26*a* of the development cartridge 24 was filled with suspension polymerization toner during the preceding development operation usage of the development cartridge 24. Next, an example will be described for a refilling operation performed when it is determined that the toner chamber 26*a* was filled with emulsion polymerization toner during the preceding development operation usage. More specifically, the emulsion polymerization toner that was used in the preceding development operation usage of the development cartridge 24 contains external additive for a coverage rate of 60% to 120%. This results in a fluidity characteristic of 70 to 85.

Therefore, the refill toner should have a fluidity characteristic that is lower than the fluidity characteristic of this emulsion polymerization toner. As in the first example, it is also desirable that the fluidity characteristic of the refill toner be higher than that of non-globular-formized pulverized toner. Therefore, it is desirable that the refill toner have a fluidity characteristic from 60 to 80, and preferably from 65 to 75, depending on the specific fluidity characteristic of the toner of the previous usage.

For example, the refill toner could be an emulsion polymerization toner that contains a smaller amount of external additive than the amount of external additive contained in the emulsion polymerization toner that was used in the development cartridge 24 during the preceding development operation usage. More specifically, the refill toner could be an emulsion polymerization toner with external additive for a coverage rate of 20% to 50%. When external additive is added to achieve this coverage rate, the fluidity characteristic of the emulsion polymerization toner is from 70 to 80.

Alternatively, the refill toner could be a globular formized pulverized toner. As described above, globular formized, pulverized toner can be produced by subjecting a pulverized toner to globular formized processes using a Mechanofusion AMS produced by the Hosogawa Micron Group. In this case, the globular formized, pulverized toner has an average particle diameter of about 6 to 10 microns and a fluidity characteristic of 60 to 70. Alternatively, globular formized, pulverized toner can be obtained by thermally processing pulverized toner. In this case, the globular formized pulverized toner has an average particle diameter of about 6 to 10 microns and a fluidity characteristic of from 70 to 80.

As described above, the emulsion polymerization toner that contains a smaller amount of external additive (20% to 50%) and the globular formized pulverized toner have a fluidity characteristic in the range of 60 to 80, which is lower than the fluidity characteristic of the emulsion polymerization toner that filled the development cartridge 24 during the preceding development operation usage. Therefore, the refill toner will not leak from the development cartridge 24, even if the side seals 58 are retained from the preceding development operation usage. Moreover, because the toner has a better fluidity characteristic than non-globular-formized pulverized toner, good image quality can be achieved.

Experiments were performed to determine suitability of various toners for refilling the development cartridge 24 when emulsion polymerization toner was used during the preceding development operation usage of the development cartridge 24. Before the experiments, a development cartridge 24 filled with emulsion polymerization toner was used for developing operations until the toner ran out. The emulsion polymerization toner that filled the development cartridges 24 had an external additive coating rate of 90% and a fluidity characteristic of 83. Then, the development cartridge 24 was refilled with one of the five different types of toner indicated in Table 3. The developing cartridge 24 was then mounted in the laser printer 1 and reused to develop images on 6,000 sheets using 5% of the print duty of the printer 1. This experiment was repeated 10 times for each different type of toner, using a different development cartridge 24 for each repetition, that is, ten different cartridges 24 for each toner type, for a total of 50 development cartridges 24. The suitability of the different toners was judged based on the amount of toner leaking that was observed. The results of the experiments are shown in Table 3. In Table 3, the number of defective units refers to the number of development cartridges out of ten tested that showed toner leaks or distorted images.

| TYPE OF TONER | A | B | C | D | E |
|---|---|---|---|---|---|
| FEATURE | 90% COVER RATE | 45% COVER RATE | THERMAL PROC. | MECHANO-FUSION PROC. | NONE |
| FLUIDITY CHARACTER-ISTIC | 83 | 73 | 76 | 64 | 50 |
| NUMBER OF DEFECTIVE UNITS | 3 | 1 | 0 | 0 | 10 |
| EVAL-UATION | POOR[1] | GOOD[2] | GOOD[3] | GOOD[4] | POOR[5] |

A: Emulsion polymerization toner (higher external additive coating rate)
B: Emulsion polymerization toner (lower external additive coating rate)
C: Pulverized toner that was thermally globular formized
D: Pulverized toner that was globular formized by mechanafusion
E: Pulverized toner (not globular formized)
[1]Three of the ten developing cartridge leaked more than normal. The amount of leakage was small enough to enable use of the developing cartridge, but the was not appropriate for reuse of the developing cartridge.
[2]One of the ten developing cartridge leaked more than normal. Only a small amount of toner leaked, not enough to prevent use of the developing cartridge.
[3]Almost no toner leakage.
[4]Images where slightly distorted. However, not enough to prevent usage.
[5]Images were clearly distorted after about 3,000 sheets. Afterward, the distortion too severe to continue use.

As shown in Table 3, three of the ten development cartridges 24 leaked in greater amounts than when a new development cartridge 24 was used when the development cartridge was refilled with the same type of toner that was used both during the preceding development operation usage, that is, when the development cartridge was refilled with emulsion polymerization toner having an external additive coating rate of 90% and a fluidity characteristic of 83.

On the other hand, only a slight amount of toner leaked from the developing cartridges 24 when the refill toner had a lower fluidity characteristic than the toner used the previous time. The toner leaked in amounts substantially the same as when a new development cartridge 24 was used. However, it should be noted that when non-globular-formized pulverized toner was used as the refill toner, then images printed by the laser printer 1 were distorted with vertical lines for ten out of the ten developing cartridges 24.

Therefore, it was determined that non-globular-formized toner is inappropriate as a refill toner.

Next, a method of refilling a used development cartridge according to a second embodiment of the present invention will be described. The development cartridge and laser printer of the second embodiment have the same configuration as described in the first embodiment, so their description will be omitted to avoid redundancy of explanation.

According to the second embodiment, in the same manner as in the first embodiment, the type of previously-used toner that remains in the toner chamber 26*a* from the preceding development operation usage is determined before the toner chamber 26*a* of the development cartridge 24 is refilled with toner. However, according to the second embodiment, once the type of previously-used toner is determined, then a different type of toner that has a lower melting characteristic than the previously-used toner is designated. Then the toner chamber 26*a* is refilled with the type of toner that has the lower melting characteristic.

The melting characteristic represents the ease at which the toner melts. For example, toners that have a higher glass transition point have a lower melting characteristic than toners with a lower glass transition point. Also, toners that have a larger average particle diameter have a lower melting characteristic than toners with a smaller average particle diameter. Further, a toner wherein each particle has a uniform softening temperature throughout has a lower melting characteristic than a capsule toner with an inner core and an outer shell that have different thermal characteristics.

It should be noted that the second embodiment has no particular limitations to the type of toner that fills the toner chamber 26*a* during the preceding development operation usage, as long as the refill toner has a lower melting characteristic. For example, the toner from the preceding usage could be suspension polymerization toner, emulsion polymerization toner, a capsule toner, or some other type of polymerization toner, or could be either globular formized or non-globular-formized pulverized toner.

As mentioned previously, the side seals 58 are abraded down during developing operations of the development cartridge 24, and so have reduced sealing capability by the time the toner runs out during a preceding developing operation usage of the development cartridge 24. Therefore, when the development cartridge 24 is refilled with toner and again used for developing operations, the side seals 58 are incapable of completely preventing toner from entering in between the side seals 58 and the developing roller 27.

In the conventional situation, such toner that entered in between the seal members and the developing roller will melt by rubbing contact from the rotating developing roller. When the developing roller stops rotating, then the once melted toner cools and solidifies onto the developing roller. When the developing roller is later driven to rotate once again, the solidified toner on the surface of the developing roller can cut into the seal members as the developing roller rotates, thereby speeding the degradation of the seal members so that toner leaks through gaps between the seal member and the developing roller to outside the developing cartridge.

However, according to the second embodiment, the toner chamber 26*a* is refilled with a type of toner that has a lower melting characteristic than the melting characteristic of the previously-used toner. Therefore, the toner will not melt even if the refill toner enters between the side seals 58 and the developing roller 27 when the development cartridge 24 is reused. Therefore, there is no need to replace the side seals 58 when cleaning out the used development cartridge 24, because the used side seals 58 will be sufficient, even if their sealing capability is slightly degraded. The costs and trouble of replacing the seal members can be reduced so that efficient refilling operations can be achieved. Because the refill toner will not easily melt by rubbing contact with the developing roller, the refill toner will not melt and solidify, and consequently will not cut into the developing roller 27 or and the side seals 58.

For example, if the previously-used toner that remains in the toner chamber 26*a* from a preceding developing operation usage is determined to be of a type that has a glass transition point of 63° C., then a type of toner that has a glass transition point of 65° C. or greater can be designated as the refill toner. Because the glass transition point of the refill toner is higher than the toner from the preceding developing operation usage, the melting characteristic of the refill toner is lower. Therefore, the refill toner is less likely to melt in between the side seals 58 and the developing roller 27 when the development cartridge 24 is reused.

In another example, if the previously-used toner that remains in the toner chamber 26*a* from a preceding developing operation usage is determined to be of a type that has an average particle diameter in the range of 8 to 11 microns, or more specifically, in the range of 9 to 10 microns, then a type of toner that has an average particle diameter in the range of 11 to 14 microns, or more specifically, in the range of 11 to 12 microns can be designated as the refill toner. In this example, it should be understood that when the toner of the previous usage has an average particle diameter of 11 microns, then the development cartridge 24 should be filled with a toner that has a larger average particle diameter from the range of 11 to 14 microns. Because the average particle diameter of the refill toner is larger than the toner of the preceding developing operation usage, the melting characteristic of the refill toner is lower. Therefore, the refill toner is less likely to melt in between the side seals 58 and the developing roller 27 when the development cartridge 24 is reused. Moreover, when the refill toner has a larger average particle diameter in this way, even the degraded sealing capability of the side seals 58 will be sufficient to prevent the refill toner from entering between the side seals 58 and the developing roller 27 during reuse of the development cartridge 24. Thus, the problem of the toner melting and then solidifying between the side seals 58 and the developing roller 27 can be even more reliably prevented.

Capsule toner is a type of polymerization toner. Each toner particle of the capsule toner has a multi-layer structure, commonly a double-layer structure with an inner core and an outer shell. The polymer of the inner core has a lower softening temperature than the polymer of the outer shell. Because the two layers have different softening temperatures in this manner, the capsule toner easily melts at low temperatures, so the capsule toner has excellent fixing properties at much lower temperatures than are capable for toner wherein each particle has a uniform softening temperature throughout.

According to the present embodiment, if the previously-used toner that remains in the toner chamber 26*a* from a preceding developing operation usage is determined to be a capsule toner, then a toner wherein each particle has a uniform softening temperature throughout is designated as the refill toner. Because such a refill toner has a much lower melting characteristic than capsule toner, the toner will not easily melt by rubbing contact with the developing roller 27, even if the refill toner enters between the side seals 58 and the developing roller 27. Therefore, the problem of toner solidifying after melting, and then cutting into the developing roller 27 or the side seals 58, can be prevented. For this reason, toner can be prevented from leaking out from the development cartridge 24 while properly reusing the development cartridge 24.

It is desirable that the capsule toner be obtained by polymerizing the inner core and then, in a subsequent polymerization operation, covering the inner core with an outer shell having a higher softening temperature than the inner core. With this type of capsule toner, the inner core melts much more easily than the outer shell, which translates into the capsule toner overall having a high melting characteristic. In contrast, a refill toner wherein each particles has uniform softening temperature throughout will have a much lower melting characteristic, so even if the refill toner enters between the side seals 58 and the developing roller 27 during reuse of the development cartridge 24, the refill toner will be even less likely to melt than the capsule toner. Therefore, the problem of toner solidifying after melting, and then cutting into the developing roller 27 or the side seals 58, can be effectively prevented. For this reason, toner can be prevented from leaking out from the development cartridge 24 while properly reusing the development cartridge 24.

It should be noted that when capsule toner was used in the preceding developing operation usage, then the effects of both the first and second embodiments can be achieved by using globular formized pulverized toner as the refill toner. That is, globular formized pulverized toner has both a lower melting characteristic and a lower fluidity characteristic than capsule toner so the effects of both the first and second embodiments can be achieved.

While some exemplary embodiments of this invention have been described in detail, those skilled in the art will recognize that there are many possible modifications and variations which may be made in these exemplary embodiments while yet retaining many of the novel features and advantages of the invention.

For example, the first embodiment describes removing polymerization toner, specifically, suspension polymerization toner or emulsion polymerization toner, from the toner chamber 26*a* until 1.2 g/cm or less, and preferably 0.7 g/cm or less, remains in the toner chamber 26*a* per axial direction length of the developing roller 27. However, it should be noted that substantial effects can be achieved regardless of what toner is removed until 1.2 g/cm or less, and preferably 0.7 g/cm or less, remains in the toner chamber 26*a* per axial direction length of the developing roller 27. That is, regardless of whether the toner of the preceding developing operation usage was a polymerization toner (suspension polymerization toner, emulsion polymerization toner, or capsule toner) or a pulverized toner (whether globular formized or not), fogging can be prevented if the toner is removed until 1.2 g/cm or less, and preferably 0.7 g/cm or less, remains in the toner chamber 26*a* per axial direction length of the developing roller 27. Similarly, with this aspect of the present invention, there are no particular limitations to the type of toner used to refill the development cartridge 24. The refill toner could be the same type as or different type from the toner that was used during the previous development operation usage of the development cartridge 24.

Also, the second embodiment describes obtaining capsule toner by polymerizing the inner core and then, in a subsequent polymerization operation, covering the inner core with an outer shell having a higher softening temperature than the inner core. However, the capsule toner can instead be obtained by polymerization of both the inner and outer shells at the same time.

Although the embodiment describes determining the type of previously-used toner from the preceding development operation usage by referring to the model of the toner cartridge, the user could determine the type of previously-used toner by opening the toner cap 60 and investigating the texture of the previously-used toner. In other words, the step of determining the type of previously-used toner could be performed either before or after the toner cap 60 is opened.

What is claimed is:

1. A method of refilling a used developing device with developing agent for developing electrostatic latent images, the developing device including a holding chamber for holding developing agent, a port for accessing the holding chamber from outside the used developing device, and a developing agent bearing member that bears developing agent from the holding chamber to an image developing position for developing electrostatic latent images, the method comprising the steps of:

opening the port to access the holding chamber;

determining a type of previously-used developing agent that remains in the holding chamber from a preceding developing operation usage;

designating a type of developing agent that has a lower fluidity characteristic than the previously-used developing agent, the fluidity characteristic representing fluidity of the developing agent;

refilling the holding chamber with the type of developing agent that has the lower fluidity characteristic; and closing the port.

2. A method as claimed in claim 1, wherein:

the step of designating a type of developing agent that has a lower fluidity characteristic includes designating a type of developing agent that, in addition to a lower fluidity characteristic, has a lower melting characteristic than the previously-used developing agent, the melting character representing ease at which the developing agent melts; and the step of refilling the holding chamber includes filling with the type of developing agent that has the lower fluidity characteristic and the lower melting characteristic.

3. A method as claimed in claim 1, further comprising the step of removing at least a portion of the previously-used developing agent before executing the step of refilling.

4. A method as claimed in claim 3, wherein the developing agent bearing member is elongated in an axial direction and has an axial length in the axial direction, the step of removing including removing the previously-used developing agent to an amount of 1.2 g or less per centimeter of the axial length of the developing agent bearing member.

5. A method as claimed in claim 4, wherein the step of removing includes removing the previously-used developing agent to an amount of 0.7 g or less per centimeter of the axial length of the developing agent bearing member.

6. A method as claimed in claim 1, wherein when the previously-used developing agent is determined to be residual suspension polymerization toner including external additive for enhancing the fluidity characteristic of the residual suspension polymerization toner:

the step of determining the type of previously-used developing agent includes determining amount of the external additive; and the step of designating the type of developing agent that has a lower fluidity characteristic includes designating a suspension polymerization toner that contains a smaller amount of external additive than the amount of external additive contained in the residual suspension polymerization toner.

7. A method as claimed in claim 1, wherein when the type of previously-used developing agent is determined to be residual suspension polymerization toner, the step of designating includes designating an emulsion polymerization toner.

8. A method as claimed in claim 1, wherein when the type of previously-used developing agent is determined to be residual suspension polymerization toner, the step of designating the type of developing agent that has a lower fluidity characteristic includes designating a pulverized toner that was subjected to globular formized processing.

9. A method as claimed in claim 1, wherein when the type of previously-used developing agent is determined to be residual emulsion polymerization toner including external additive for enhancing the fluidity characteristic of the residual emulsion polymerization toner, the step of determining the type of previously-used developing agent includes determining amount of the external additive; and the step of designating the type of developing agent that has a lower fluidity characteristic includes designating an emulsion polymerization toner that contains a smaller amount of external additive than the amount of external additive contained in the residual emulsion polymerization toner.

10. A method as claimed in claim 1, wherein when the type of previously-used developing agent is determined to be residual emulsion polymerization toner, the step of designating the type of developing agent that has a lower fluidity characteristic includes designating a pulverized toner that was subjected to globular formized processing.

11. A method as claimed in claim 1, further comprising the step of replacing the developing agent bearing member with a different developing agent bearing member before executing the step of refilling.

12. A method as claimed in claim 11, wherein the step of replacing the developing agent bearing member includes:

determining bearing capacity of the developing agent bearing member, the bearing capacity representing amount of developing agent the developing agent bearing member can bear per unit surface area of the developing agent bearing member;

designating a different developing agent bearing member with a lower bearing capacity than the bearing capacity of the developing agent bearing member; and replacing the developing agent bearing member with the different developing agent bearing member.

13. A method as claimed in claim 12, wherein:

the step of determining bearing capacity of the developing agent bearing member includes determining surface roughness of the developing agent bearing member; and the step of designating a different developing agent bearing member with a lower bearing capacity includes designating a different developing agent bearing member with a lower surface roughness than the developing agent bearing member.

14. A method as claimed in claim 12, wherein:

the step of determining bearing capacity of the developing agent bearing member includes determining surface hardness of the developing agent bearing member; and the step of designating a different developing agent bearing member with a lower bearing capacity includes designating a different developing agent bearing member with a lower surface hardness than the developing agent bearing member.

15. A method as claimed in claim 11, wherein the developing agent bearing member has a cylindrical shape with an outer diameter, the step of replacing the developing agent bearing member including:

determining the outer diameter of the developing agent bearing member;

designating a different developing agent bearing member with a larger outer diameter than the developing agent bearing member; and replacing the developing agent bearing member with the different developing agent bearing member.

16. A method as claimed in claim 1, wherein the step of designating the type of developing agent that has a lower fluidity characteristic includes designating developing agent with a fluidity characteristic that is higher than fluidity characteristic of a pulverized toner that was not subjected to globular formized processing.

17. A method of refilling a used developing device with developing agent for developing electrostatic latent images, the used developing device including a holding chamber for holding developing agent, a port for accessing the holding chamber from outside the used developing device, and a developing agent bearing member that bears developing agent from the holding chamber to an image developing position for developing electrostatic latent images, the method comprising the steps of:

opening the port to access the holding chamber;

determining a type of previously-used developing agent that remains in the holding chamber from a preceding developing operation usage;

designating a type of developing agent that has a lower melting characteristic than the previously-used developing agent, the melting characteristic representing ease at which the developing agent melts;

refilling the holding chamber with the type of developing agent that has the lower melting characteristic; and closing the port.

18. A method as claimed in claim 17, further comprising the step of removing at least a portion of the previously-used developing agent before executing the step of refilling.

19. A method as claimed in claim 18, wherein the developing agent bearing member is elongated in an axial direction and has an axial length in the axial direction, the step of removing including removing the previously-used developing agent to an amount of 1.2 g or less per centimeter of the axial length of the developing agent bearing member.

20. A method as claimed in claim 19, wherein the step of removing includes removing the previously-used developing agent to an amount of 0.7 g or less per centimeter of the axial length of the developing agent bearing member.

21. A method as claimed in claim 17, wherein:

the step of determining the type of previously-used developing agent includes determining glass transition point of the previously-used developing agent; and the step of designating the type of developing agent includes designating a developing agent that has a higher glass transition point than the glass transition point of the previously-used developing agent.

22. A method as claimed in claim 17, wherein:

the step of determining the type of previously-used developing agent includes determining average particle diameter of the previously-used developing agent; and the step of designating the type of developing agent includes designating a developing agent that has a larger average particle diameter than the average particle diameter of the previously-used developing agent.

23. A method as claimed in claim 17, wherein when the type of previously-used developing agent is determined to be a capsule toner having an inner core and an outer shell with different thermal characteristics, the step of designating the type of developing agent includes designating a developing agent having uniform thermal characteristics throughout each particle.

24. A method as claimed in claim 23, wherein the previously-used developing agent is a capsule toner having an outer shell with a lower melting characteristic than the inner core.

25. A method as claimed in claim 17, further comprising the step of replacing the developing agent bearing member with a different developing agent bearing member before executing the step of refilling.

26. A method as claimed in claim 25, wherein step of replacing the developing agent bearing member includes:

determining bearing capacity of the developing agent bearing member, the bearing capacity representing amount of developing agent the developing agent bearing member can bear per unit surface area of the developing agent bearing member;

designating a different developing agent bearing member with a lower bearing capacity than the bearing capacity of the developing agent bearing member; and replacing the developing agent bearing member with the different developing agent bearing member.

27. A method as claimed in claim 26, wherein:

the step of determining bearing capacity of the developing agent bearing member includes determining surface roughness of the developing agent bearing member; and the step of designating a different developing agent bearing member with a lower bearing capacity includes designating a different developing agent bearing member with a lower surface roughness than the developing agent bearing member.

28. A method as claimed in claim 26, wherein:

the step of determining bearing capacity of the developing agent bearing member includes determining surface hardness of the developing agent bearing member; and the step of designating a different developing agent bearing member with a lower bearing capacity includes designating a different developing agent bearing member with a lower surface hardness than the developing agent bearing member.

29. A method as claimed in claim 25, wherein the developing agent-bearing member has a cylindrical shape with an outer diameter, the step of replacing the developing agent bearing member including:

determining the outer diameter of the developing agent bearing member;

designating a different developing agent bearing member with a larger outer diameter than the developing agent bearing member; and replacing the developing agent bearing member with the different developing agent bearing member.

30. A method of reusing a used developing device, the used developing device including a holding chamber for holding developing agent, a port for accessing the holding chamber from outside the used developing device, and an axially-elongated developing agent bearing member that bears developing agent from the holding chamber to an image developing position for developing electrostatic latent images, the developing agent bearing member having an axial length in a direction in which the developing agent bearing member is axially elongated, the method comprising the step of:

opening the port to access the holding chamber;

removing previously-used developing agent from a preceding developing operation usage of the used developing device to an amount of 1.2 g or less per centimeter of the axial length of the developing agent bearing member;

refilling the holding chamber with developing agent; and closing the port.

31. A method as claimed in claim 30, wherein:

the step of removing the previously-used developing agent includes determining amount of previously-used developing agent after removal; and the step of refilling the holding chamber includes refilling the holding chamber with eight times or more than the amount of previously-used developing agent.

32. A method as claimed in claim 30, wherein the step of removing includes removing the previously-used developing agent to an amount of 0.7 g or less per centimeter of the axial length of the developing agent bearing member.

33. A developing device for developing electrostatic latent images at an image developing position, the developing device comprising:

a holding chamber for holding developing agent for developing the electrostatic latent images;

a port for accessing the holding chamber from outside the used developing device; and a developing agent bearing member that bears developing agent from the holding chamber to the image developing position for developing the electrostatic latent images, wherein the holding chamber holds developing agent refilled by opening the port to access the holding chamber, determining a type of previously-used developing agent that remains in the holding chamber from a preceding developing operation usage, designating a type of developing agent that has a lower fluidity characteristic than the previously-used developing agent, the fluidity characteristic representing fluidity of the developing agent, refilling the holding chamber with the type of developing agent that has the lower fluidity characteristic, and closing the port.

34. A developing device for developing electrostatic latent images at an image developing position, the developing device comprising:

a holding chamber for holding developing agent for developing the electrostatic latent images;

a port for accessing the holding chamber from outside the used developing device; and a developing agent bearing member that bears developing agent from the holding chamber to the image developing position for developing the electrostatic latent images, wherein the holding chamber holds developing agent refilled by opening the port to access the holding chamber, determining a type of previously-used developing agent that remains in the holding chamber from a preceding developing operation usage, designating a type of developing agent that has a lower melting characteristic than the previously-used developing agent, the melting characteristic representing ease at which the developing agent melts, refilling the holding chamber with the type of developing agent that has the lower melting characteristic, and closing the port.

35. A developing device for developing electrostatic latent images at an image developing position, the developing device comprising:

a holding chamber for holding developing agent for developing the electrostatic latent images;

a port for accessing the holding chamber from outside the used developing device; and a developing agent bearing member that bears developing agent from the holding chamber to the image developing position for developing the electrostatic latent images, the developing agent bearing member having an axial length in a direction in which the developing agent bearing member is axially elongated, wherein the holding chamber holds developing agent refilled by opening the port to access the holding chamber, removing previously-used developing agent from a preceding developing operation usage of the used developing device to an amount of 1.2 g or less per centimeter of the axial length of the developing agent bearing member, refilling the holding chamber with developing agent, and closing the port.

36. A developing device for performing developing operations to develop electrostatic latent images at an image developing position, the developing device having been used previously to perform developing operations using developing agent, the developing device comprising:

a holding chamber for holding developing agent for developing the electrostatic latent images, the developing agent being a type of developing agent that has a lower fluidity characteristic than previously-used developing agent that was used during the previously performed developing operations, the fluidity characteristic representing fluidity of the developing agent; and a developing agent bearing member that bears the developing agent from the holding chamber to the image developing position for developing the electrostatic latent images.

37. A developing device as claimed in claim 36, wherein the previously-used developing agent is residual suspension polymerization toner including external additive for enhancing the fluidity characteristic of the residual suspension polymerization toner, the holding chamber holding a suspension polymerization toner that contains a smaller amount of external additive than an amount of external additive contained in the residual suspension polymerization toner.

38. A developing device as claimed in claim 36, wherein the previously-used developing agent is residual suspension polymerization toner, the holding chamber holding an emulsion polymerization toner.

39. A developing device as claimed in claim 36, wherein the previously-used developing agent is residual suspension polymerization toner, the holding chamber holding a pulverized toner that was subjected to globular formized processing.

40. A developing device as claimed in claim 36, wherein the previously-used developing agent is residual emulsion polymerization toner including external additive for enhancing the fluidity characteristic of the residual emulsion polymerization toner, the holding chamber holding an emulsion polymerization toner that contains a smaller amount of external additive than an amount of external additive contained in the residual emulsion polymerization toner.

41. A developing device as claimed in claim 36, wherein the previously-used developing agent is residual emulsion polymerization toner, the holding chamber holding a pulverized toner that was subjected to globular formized processing.

42. A developing device as claimed in claim 36, wherein the holding chamber includes two side walls in confrontation with each other, further comprising:

an access port for accessing the holding chamber from outside to refill the holding chamber with developing agent, the access port being provided on one of the two side walls; and a drive mechanism for driving movement of the developing agent bearing member, the drive mechanism being provided on the other of the two side walls.

43. A developing device for performing developing operations to develop electrostatic latent images at an image developing position, the developing device having been used previously to perform developing operations using developing agent, the developing device comprising:

a holding chamber for holding developing agent for developing the electrostatic latent images, the developing agent being a type of developing agent that has a lower melting characteristic than the developing agent that was used during the previously performed developing operations, the melting characteristic representing ease at which the developing agent melts; and a developing agent bearing member that bears the developing agent from the holding chamber to the image developing position for developing the electrostatic latent images.

44. A developing device as claimed in claim 43, wherein the holding chamber holds developing agent that has a higher glass transition point than a glass transition point of the previously-used developing agent.

45. A developing device as claimed in claim 43, wherein the holding chamber holds developing agent that has larger average particle diameter than an average particle diameter of the previously-used developing agent.

46. A developing device as claimed in claim 43, wherein the previously-used developing agent is a capsule toner having an inner core and an outer shell with different thermal characteristics, the holding chamber holding developing agent that has uniform thermal characteristics throughout each particle.

47. A developing device as claimed in claim 43, wherein the holding chamber includes two side walls in confrontation with each other, further comprising:

an access port for accessing the holding chamber from outside to refill the holding chamber with developing agent, the access port being provided on one of the two side walls; and a drive mechanism for driving movement of the developing agent bearing member, the drive mechanism being provided on the other of the two side walls.

* * * * *